US008360484B2

(12) United States Patent
Liang et al.

(10) Patent No.: US 8,360,484 B2
(45) Date of Patent: Jan. 29, 2013

(54) VENT STOP FOR WOODEN AND OTHER WINDOWS

(75) Inventors: Luke Liang, South Plainfield, NJ (US); Tong Liang, Guang Zhou (CN); David Chen, Guang Zhou (CN)

(73) Assignee: Vision Industries Group, Inc.

( * ) Notice: Subject to any disclaimer, the term of this patent is extended or adjusted under 35 U.S.C. 154(b) by 115 days.

(21) Appl. No.: 12/804,895

(22) Filed: Jul. 30, 2010

(65) Prior Publication Data

US 2011/0062727 A1 Mar. 17, 2011

Related U.S. Application Data

(63) Continuation-in-part of application No. 12/802,640, filed on Jun. 10, 2010.

(60) Provisional application No. 61/273,131, filed on Jul. 30, 2009.

(51) Int. Cl.
*E05C 3/16* (2006.01)
*E05C 17/44* (2006.01)

(52) U.S. Cl. ..... 292/220; 292/338; 292/DIG. 20; 49/449

(58) Field of Classification Search ..... 292/220, 292/338, 339, DIG. 20, DIG. 53, DIG. 54; 49/449

See application file for complete search history.

(56) References Cited

U.S. PATENT DOCUMENTS 534,185 A * 2/1895 Winchester ..... 292/63
769,767 A * 9/1904 Phelps ..... 70/90
804,994 A * 11/1905 Andrews ..... 292/219
1,003,386 A * 9/1911 Welker ..... 292/219
1,173,129 A * 2/1916 Taliaferro ..... 292/219
1,322,677 A * 11/1919 Ditlefsen ..... 292/219
1,470,858 A * 10/1923 Maxwell ..... 70/370
3,190,683 A * 6/1965 Schlage ..... 292/1.5
4,824,154 A * 4/1989 Simpson ..... 292/338
4,923,230 A * 5/1990 Simpson ..... 292/67
5,094,489 A * 3/1992 Jones ..... 292/340
5,248,174 A * 9/1993 Matz et al. ..... 292/338
5,474,346 A * 12/1995 Fann et al. ..... 292/337
5,480,117 A * 1/1996 Fleming, III ..... 248/231.9
5,536,052 A * 7/1996 Maier ..... 292/63
5,575,116 A * 11/1996 Carlson et al. ..... 49/449
5,806,900 A * 9/1998 Bratcher et al. ..... 292/137
6,572,158 B2 * 6/2003 Szapucki et al. ..... 292/221
7,431,356 B2 * 10/2008 Liang et al. ..... 292/219
7,588,271 B1 * 9/2009 Lawrence ..... 292/241
7,600,796 B2 * 10/2009 Liang et al. ..... 292/338
7,637,544 B2 * 12/2009 Liang et al. ..... 292/338
7,699,365 B2 * 4/2010 Liang et al. ..... 292/240

* cited by examiner

*Primary Examiner* — Carlos Lugo
(74) *Attorney, Agent, or Firm* — Thomas A. O'Rourke; Bodner & O'Rourke, LLP

(57) ABSTRACT

A vent stop is installed into a window/door to limit travel therein of a sash member, and being particularly adapted to permit ease of its installation, especially into a wooden door/window. The stop incorporates multiple retention features to inhibit the stop's removal, once properly installed. The retention features include a wedge-shaped protrusion located at a distal end of the stop housing, which engages the wood of the window opening when pivotally installed therein, to secure a first end of the stop. The opposite end of the stop may be redundantly secured. A first feature for securing the opposite end may comprise one or more arcuate flanges on housing side walls, flanges being adapted to unidirectional movement so as to permit its movement relative to the window opening during installation, but thereafter deterring counter-pivotal motion that would allow removal of the vent stop. A second feature comprises a deformable spring clip.

22 Claims, 15 Drawing Sheets

12
20A
20B
20
21
21P
22
23
24
25
26
27
28
29
30
30A
30T
31
32
33
34
35
35E
35B
35T
36
36I
36S
36T
37
38
43S
46
47
48
49
11D
$R_{WALL}$
$R_{36I}$
$R_{36T}$
$T_{36}$

Formula for the Radius, given an arc or segment with known width and height:

$$\text{RADIUS} = \frac{H}{2} + \frac{W^2}{8H}$$

where: *W* is the length of the chord defining the base of the arc
*H* is the height measured at the midpoint of the arc's base

VENT STOP FOR WOODEN AND OTHER WINDOWS

CROSS REFERENCES TO RELATED APPLICATIONS

This application claims priority on U.S. Provisional Application Ser. No. 61/273,131 filed on Jul. 30, 2009, the disclosures of which are incorporated herein by reference.

This application is a continuation-in-part of U.S. application Ser. No. 12/802,640, filed Jun. 10, 2010, the disclosures of which are incorporated herein by reference.

FIELD OF THE INVENTION

The present invention relates to improvements in window vent stops particularly for double hung windows and the like, and to improvements in their installation and operation in preventing a window or door from opening more than a desired amount.

BACKGROUND OF THE INVENTION

Vent stops are used to restrict the opening of windows and doors, and are primarily used on double hung windows and sliding doors where a sliding sash window or door member slides from a first position to a second position. The vent stop prevents the sash from moving past a selected point, but generally permits the window to be opened a certain amount for ventilation or other purposes. For example, a window vent stop may permit a sash window to be opened four or five inches to allow air circulation, which only constitutes a portion of the window's normal travel stroke in moving from a fully closed position to a full open position. One of the considerations leading to the use of such vent stops is security concerns relating to unauthorized entry from unlocked and otherwise unprotected doors and windows.

Such door and window vent stops are typically adapted to permit installation through an opening into a hollow area of a sash member or window frame, where it is retained therein using a top plate and flexible mounting clips, such as the mounting clips 14 shown by U.S. Pat. No. 5,575,116 to Carlson for a "Window Vent Stop." Such clips are limiting in that they are not functional for a window that does not have a hollow frame, which may include new wood windows, and also many older windows already in service in building, into which a stop may be desirably installed.

The vent stop of the current invention incorporates unique retention means which permit it to be installed into windows that do not have hollow frames, and thus permit retrofit installation of the stop into older windows, and particularly wood windows.

OBJECTS OF THE INVENTION

It is an object of the invention to provide a vent stop that is easily installed into a new window currently being assembled.

It is another object of the invention to provide a vent stop that is easily installed into an older window that is still in service in a building or structure.

It is a further object of the invention to provide a vent stop that does not require mechanical fasteners such as screws, for its installation.

It is another object of the invention to provide a vent stop that resists removal from a window once installed therein.

It is also an object of the invention to provide a vent stop with multiple means of retention within an opening of a window to retain the stop therein.

Further objects and advantages of the invention will become apparent from the following description and claims, and from the accompanying drawings.

SUMMARY OF THE INVENTION

A vent stop is commonly installed into windows and doors to limit travel therein of a sash member. The vent stop, as is common in the prior art, may include a tumbler that may have a first end and a second end, with the tumbler being pivotally mounted to the housing using pin, so as to be pivotable between a retracted position, wherein the tumbler is at least partially disposed within the housing cavity, and an extended position, wherein at least a portion of the tumbler second end is protruding out the opening of the top plate of the housing. A biasing member biases the tumbler to pivot outward from the housing into the extended position. When the tumbler is in the extended position, a portion of the tumbler second end limits movement of a sliding sash of the door or window, but it permits free sash movement when the tumbler is in the retracted position.

The vent stop disclosed herein is particularly adapted to permit ease of its installation, especially into a wooden door/window, whether for concurrent installation into newly manufactured window, or for retrofit into an older window still in service in a building or structure. The vent stop incorporates multiple retention means to inhibit the stop's removal, once properly installed in the window opening, and installation which requires no additional fasteners, such as screws or bolts. The retention means includes a wedge-shaped protrusion located at a distal end of the vent stop housing, which engages the wood of the window opening when pivotally installed therein, to secure a first end of the stop. The opposite end of the stop may be redundantly secured. A first means of securing the opposite end may comprise one or more arcuate flanges on housing side walls. These arcuate flanges may be adapted to unidirectional movement so as to permit its movement relative to the window opening during pivotal installation of the stop, but thereafter deterring counter-pivotal motion that would allow deliberate or inadvertent removal of the vent stop.

A second means of securing the opposite end of the stop comprises a deformable spring clip. The spring clip may be integral to the housing or be a separate part that is secured to the housing. The spring clip is adapted to deflect during installation of the stop, with teeth on the protruding end of the spring clip being biased to engage the wood of the opening during the final steps of the installation. The teeth and the biasing of the spring clip serve to jointly ensure that attempted removal of the vent stop, produces a comparable resistance to such removal forces. A block-shaped protrusion on the housing first end ensures a tight fit—possibly an interference fit—between the vent stop and the window opening.

DETAILED DESCRIPTION OF THE INVENTION

Figure 1:
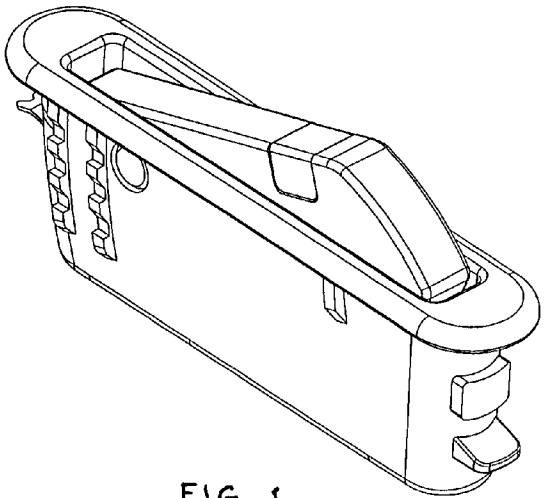
FIG. 1 is a perspective view of one embodiment of the vent stop of the present invention.
Figure 17:
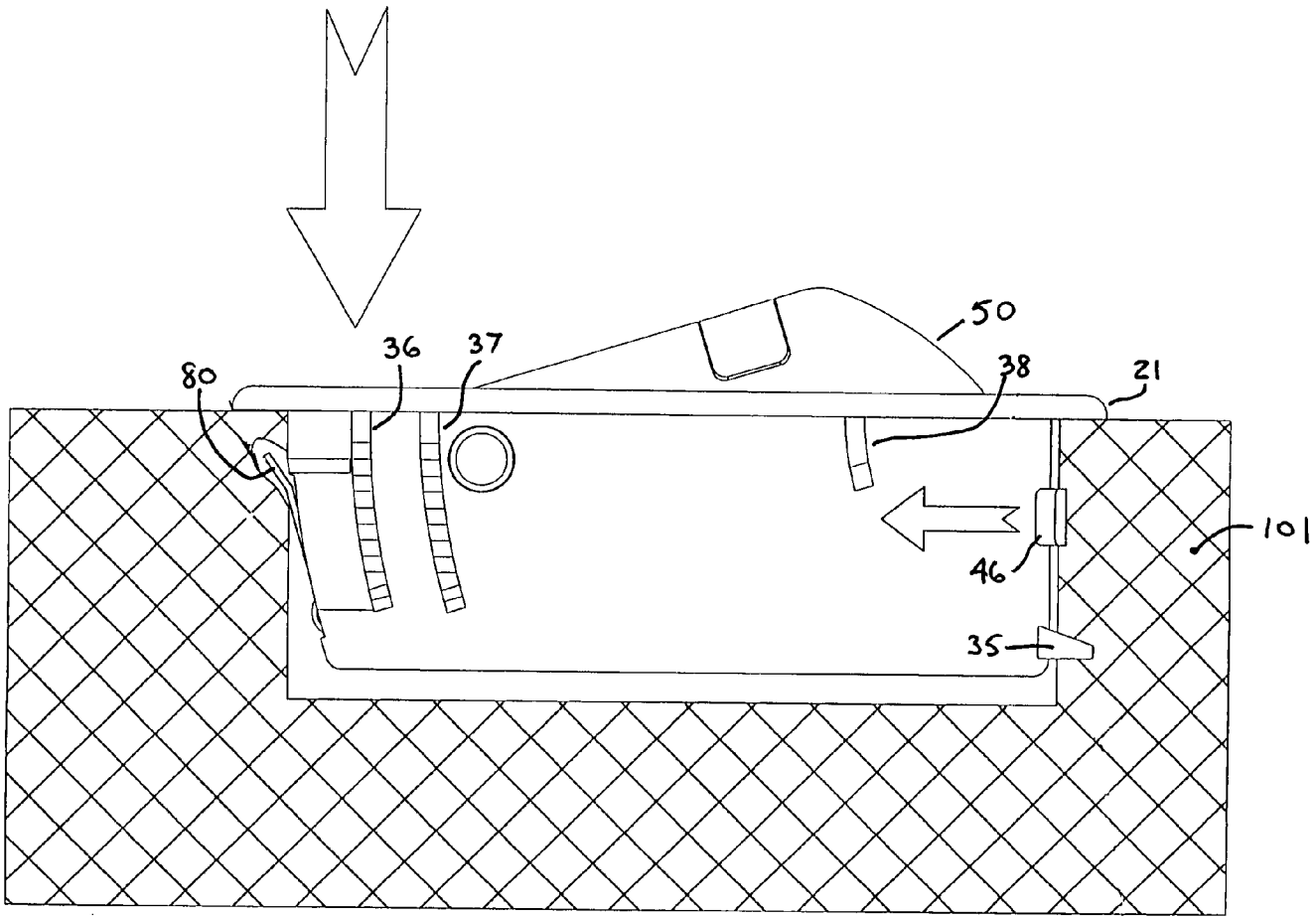
FIG. 17 is the side cross-sectional view of FIG. 17, with the stop fully installed into the slot of the window, and with the spring clip engaging the material of the slot of the window.
Figure 18:
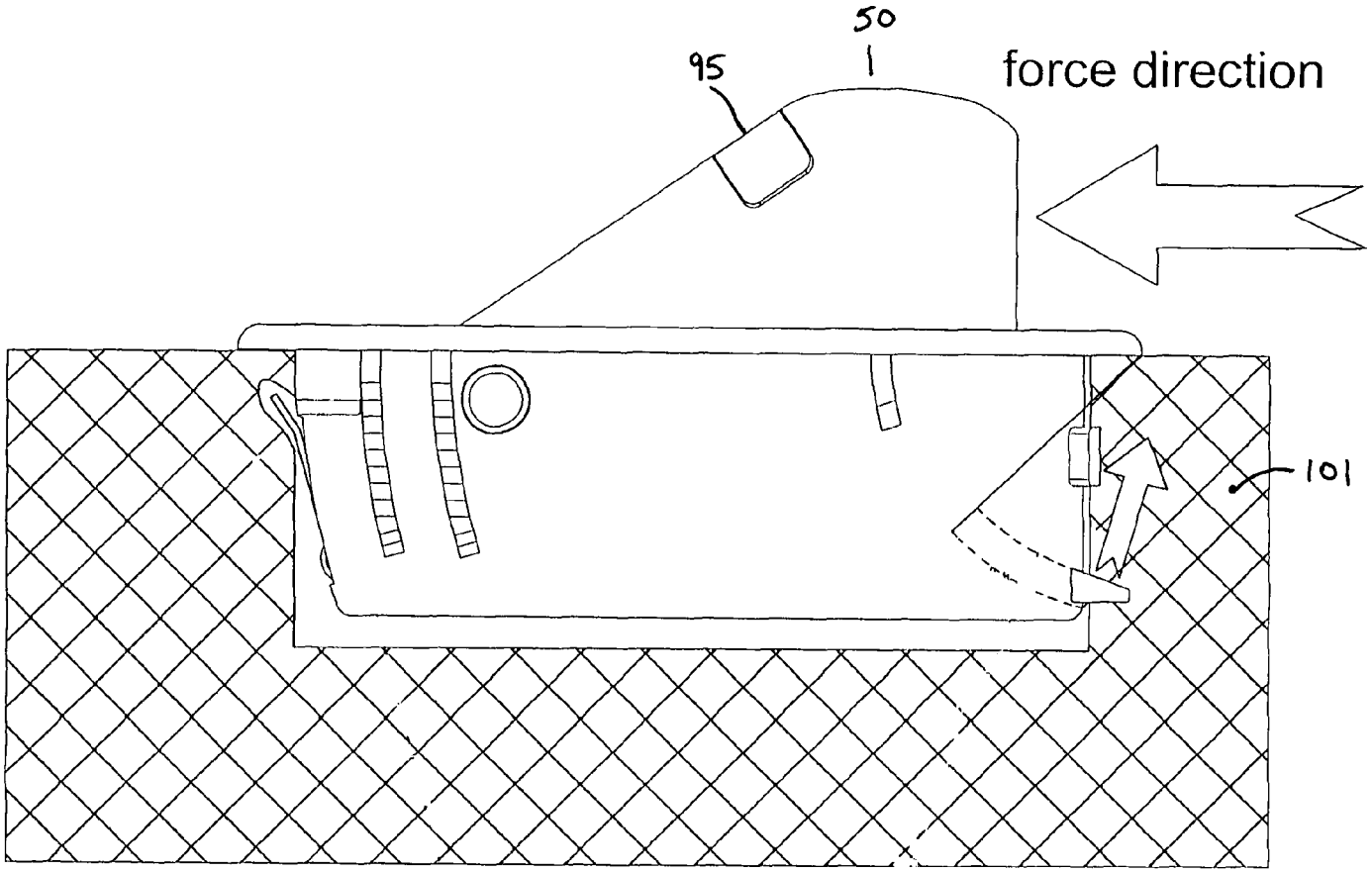
FIG. 18 is the side cross-sectional view of FIG. 17, with the stop fully installed into the slot of the window, and with the tumbler in the extended position to prevent movement of a sliding sash, with a reaction to the force of the sash member being provided by the face plate and protrusion.

FIG. 1 shows a first embodiment of the vent stop 10 of the present invention. As seen in the exploded view of FIG. 9, the vent stop 10 may include a housing 20, a tumbler 50, a biasing member 70, a spring clip 80, a pin 90, and an indicator signal member 95. The tumbler 50 may be pivotally mounted to the housing 20 using pin 90, and be biased outward from a retracted position (FIG. 17) within a housing cavity into an extended position (FIG. 18).

The housing 20 contains several features which are critical to the vent stop 10 of the current invention, which may function similar to other vent stops, but is particularly adapted for ease of installation into, and retention within a window, because of those housing features. Although the housing features make it particularly well suited for installation into a window made of wood, it may nonetheless be suitable for installation into windows made of other materials.

Figures 11, 11A, 11B, 11C, 11D:
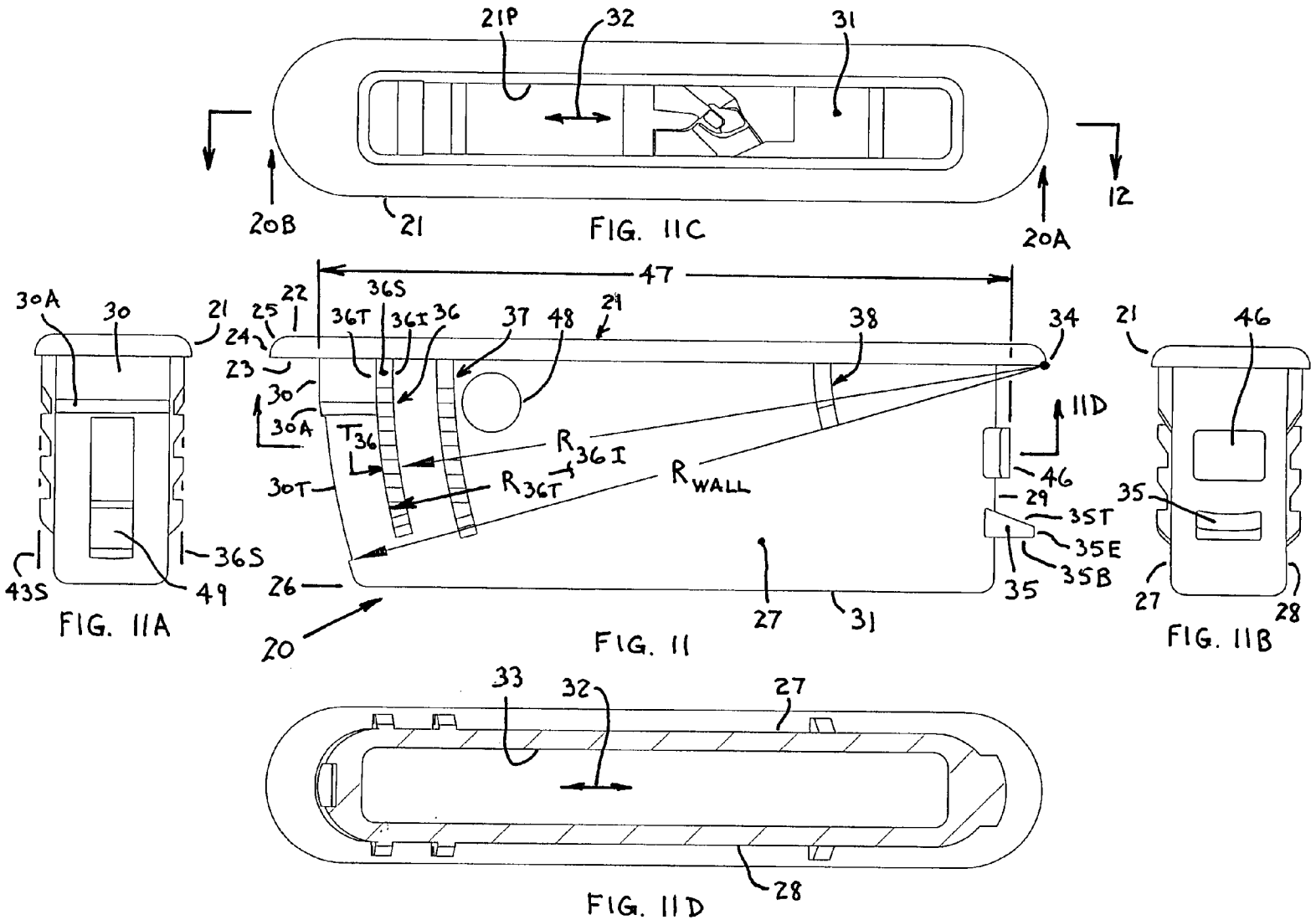
FIGS. 11-11*e* are an enlarged side view of the stop of FIG. 1.

The housing 20, as seen in FIGS. 11 and 11C, may comprise a top plate 21 with an opening 21P therein, and one or more housing walls. The top plate 21 may comprise a top surface 22, a bottom surface 23, and a peripheral edge surface 24. The intersection of the top surface 22 with the peripheral edge surface 23 may be broken using a radiused surface 25. The one or more housing walls may extend away from the bottom surface 23 of the top plate 21, to a distal end 26, and may be generally orthogonal to the top plate 21. The one or more housing walls may comprise a first side wall 27, a second side wall 28, a first end wall 29, and a second end wall 30. These side walls and end walls may be joined together using adhesive or mechanical fasteners, including, but not limited to, screws, and nuts and bolts, or may be welded together. In addition, the first and second end walls, 29 and 30, and the first and second side walls, 27 and 28, may all be formed in a manner so as to be a single continuous wall.

A single continuous wall may be the result of forming the housing 20 as a plastic, injection molded part, or as a metallic casting or a forged part, etc. In an embodiment where the housing walls are integrally formed, they may preferably be formed so as to have a first and a second generally flat side wall portion, and to have two semi-circular end wall portions to create a racetrack shape. Whether formed as separate wall members 27-30, or as a unitary wall member, the cross-section of the housing may resemble a race-track shape with an opening 33 therein to form a housing cavity 32, which may be coterminous with the faceplate opening 21P, as seen in FIG. 1, and FIGS. 11C and 11D. The distal end 26 of the housing walls may be supported and closed off by a bottom wall 31. It should be pointed out that the housing walls need not comprise a race-track shaped cross-section, and may alternatively comprise a rectangular cross-section, or other cross-sectional shape.

The second end wall 30, to accommodate installation of the vent stop in a window/door opening, as will be discussed hereinafter, may initially protrude orthogonally from the bottom surface 23 of the top plate 21, and thereafter transition into a curved portion to form part of a torus 30T. In a profile view of the second end wall 30, it may be seen that the curved shape 30T of the end wall 30 comprises an arc-segment having a radius $R_{wall}$ that may have an origin 34 proximate to the first end of the housing, and may preferably be at the extreme end of the top plate 21 at bottom surface 23. Such an origin location may assist in the installation of the vent stop, as will be discussed in the following paragraphs.

The vent stop 10 of the current invention may be retained within an opening of a window utilizing any one of, a combination of, or all of, the following retention means. The first end wall 29 may comprise a protrusion 35. Protrusion 35 may be wedge-shaped by having a top surface 35T and bottom surface 35B which converge into a knife-edge, or they may converge to terminate in an end surface 35E. The purpose of protrusion 35 is to serve as a housing member capable of being driven into the material of the window, when the vent stop 10 is installed into an opening therein. The protrusion 35 may be attached to the housing end wall 29, or be integrally formed with the first end wall 29. The protrusion 35 may work in conjunction with either of, or both of, the spring clip 80 or/and the arcuate flanges that protrude from the housing side wall portions 27 and 28. The protrusion 35 may preferably be located proximate to the distal end 26 of the first wall 29, to better facilitate the pivotal installation of the vent stop, which is discussed later.

The housing side walls (or side wall portions) 27 and 28 may comprise generally planar outside surfaces from which may protrude a flange. As seen in FIG. 11, protruding from side wall 27 may be a first flange 36. Flange 36 may be arcuate, which means to be curved like a bow, or arched. The flange may comprise any appropriate curvilinear shape, possibly being elliptical, or possibly having complex curvature. Although it need not necessarily be so, flange 36 may preferably have an inner side 36I that is formed in the shape of an arc-segment, which may have an origin at point 34, at the extreme end of the top plate bottom surface, as previously discussed. Even in the case where the inner side 36I does not comprise an arc-segment, and may, for example, alternatively be elliptical, it may, to aid in installation of the vent, have at least some point on the curved shape having a radius of curvature with its origin located at point 34.

Figure 11E:
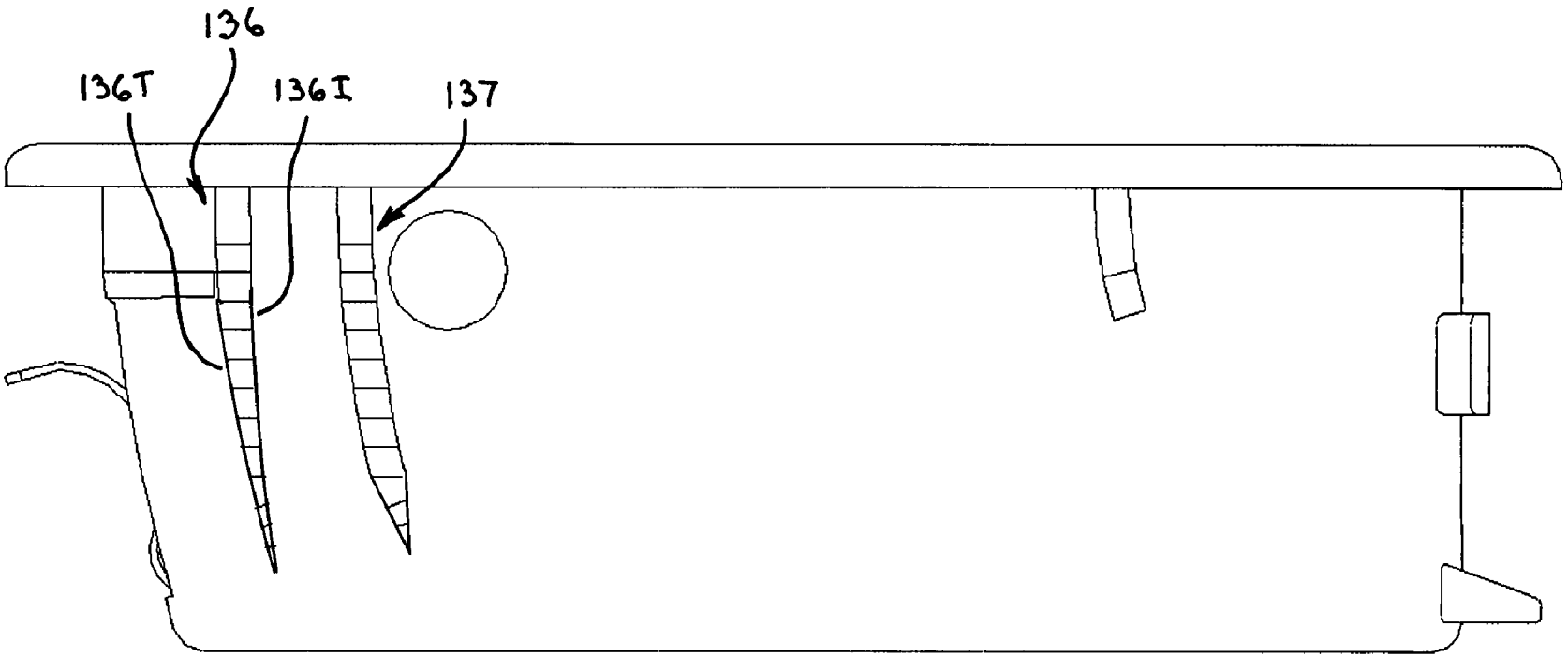

The outer side 36T of the arcuate flange 36 may be parallel to the inner side 36I so as to produce a flange having the generally constant thickness $T_{36}$, as seen in FIG. 11. It should be pointed out that the inner 36I and outer surfaces 36T (formed by $R_{36I}$ and $R_{36T}$, respectfully) need not necessarily be offset surfaces, and may, as seen in FIG. 11E, have slightly different origin locations so as to converge and form an arcuate spiked shape 136. Alternatively, as seen in FIG. 11E, they may be parallel but may eventually taper to again form a spiked end on flange 137, which may aid in the installation of the vent stop. Such tapering may only be needed where the thickness and the height of the flanges may be significant in relation to the depth of penetration required by the corresponding opening in the window, and the material type of the window.

Figure 8:
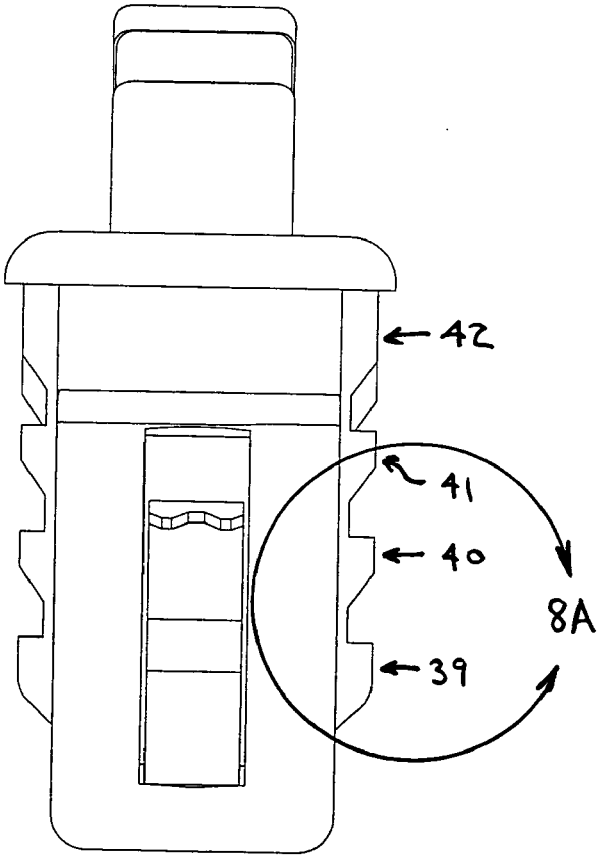
FIG. 8 is an enlarged end view of the stop of FIG. 1.
Figure 8A:
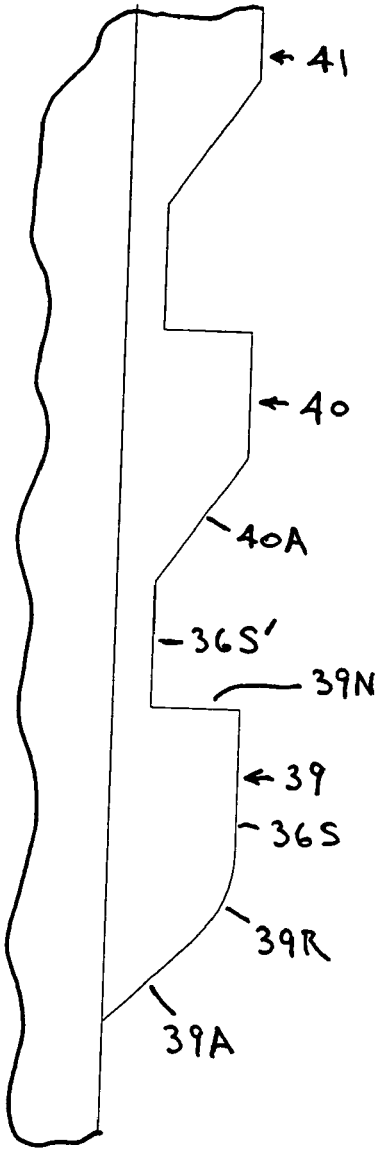
FIG. 8A is a detail view of the unidirectional feature of the arcuate flanges.

To engage the material of the window, when installed therein, the flange 36 may comprise a side surface 36S being adapted to permit, or be disposed toward engaging in, unidirectional motion upon contact with the faying surface (the opening in the window). The meaning of "fay" herein follows the conventional meaning, which is "to join or be fitted closely or tightly." Therefore the side surface 36S of the flange 36 and the portion of the window opening it contacts are faying surfaces, and will be fitted closely together, as described later. This disposition toward unidirectional motion may serve to facilitate installation of the vent stop 10 into the window opening, but may also serve to thereafter oppose its removal therefrom. As seen in the end view of FIG. 8, and the enlarged detail view of FIG. 8A, this disposition toward unidirectional motion may be provided by contouring of the flange 36 to create one or more tooth-like members, 39, 40, 41, 42, etc.

The start of the first tooth 39 may begin with an angled edge surface 39A which transitions into side surface 36S by a radiused surface 39R. The end of the tooth may be defined by a generally normal surface 36N, which terminates on a surface 36S' which is generally parallel to the flange side surface 36S. The surface 36N need not actually be normal to side surface 36S, and may be angled to provide some undercut beneath the tooth in order to provide further engagement with the material of the window opening. The surface 36S' may be parallel to side surface 36S, and provides a transition into the successive tooth 40, which may be similarly formed using an angled surface 40A and a normal surface 40N. The successive teeth may or may not also utilize the radiused transition surface, which, in the case of the first tooth 39, may serve to initially deform or penetrate the material of the window. The total height of the flange 36, the spacing of the teeth, and the depth of the teeth down to surface 36S', and other related parameters may be calibrated to achieve maximum retention within the material that the window is made from. Even where the window is a wood, those parameters may be varied to accommodate harder or softer woods that may be utilized for the window frame.

It should also be noted that the successive teeth 40, 41, 42, etc., may be progressively taller, meaning that side surface 36S would be stepped. Those teeth may also be progressively wider, meaning that the radius of the outer surface, $R_{36T}$, may become progressively larger for successive teeth. Such a progression may help to increase retention as each successive tooth may incrementally need such a size increase to provide the same level of engagement with the wood as the previous tooth. Such incremental changes may be very slight, so as to not be distinctly noticeable to the naked eye.

Figure 4:
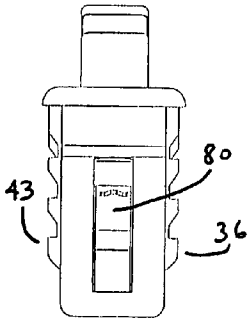
FIG. 4 is an end view of the vent stop of FIG. 1.

In one embodiment of the invention, there may be a second flange 37 being formed on wall 26, essentially the same as flange 36, with side surface 37S being generally co-planar with surface 36S, but with the flange 37 being formed by inner and outer surfaces 37I and 37T, having smaller radii—$R_{37I}$ and $R_{37T}$. To work best in conjunction with the wedge-shaped protrusion 35, the first flange 36, and the second flange 37 may preferably be formed using sufficiently large radii ($R_{36I}$, $R_{36T}$, $R_{37I}$, and $R_{37T}$) so as to have the flanges 36 and 37 located proximate to the housing second end 20B, but spaced slightly apart from each other. In another embodiment, a third flange 38 may be formed using radii ($R_{38I}$ and $R_{38T}$) so as to locate the flange 38 to be closer to the housing first end 20A. The flange 38 may or may not comprise teeth. Lastly, in another embodiment, the other side wall 28 may also be formed with flange 43, with it being comparable to flange 36, and having a unidirectional side surface 43S. In addition wall 28 may also be formed with flanges 44 and 45 (FIGS. 4 and 11A), being comparable to flanges 37-38. Those flanges 44-45 may similarly have a unidirectional side surface, which may be generally coplanar with side surface 43S. Flanges 36-38 on wall 27 and flanges 43-45 on wall 28 may be formed so as to be symmetric with each other about the mid-plane of the vent stop, which may be shown in FIG. 11C by the cutting plane represented by the section arrows therein for FIG. 12. This would result in the flanges 43-45 being mirror-image copies of the flanges 36-38. Having flanges on both side walls 27 and 28 may better serve to retain the stop within the window opening, as well as to better facilitate the vent stop installation therein.

Figure 7:
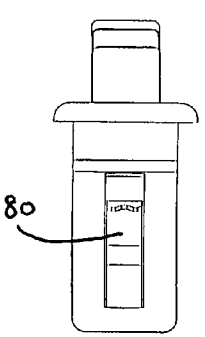
FIG. 7 is an end view of an alternative embodiment of the vent stop of FIG. 1, without the arcuate protruding flanges.
Figure 6:
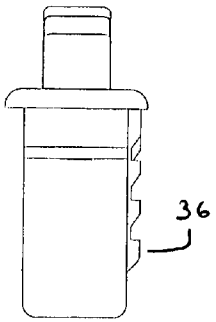
FIG. 6 is an end view of an alternative embodiment of the stop of FIG. 1, having only one protruding arcuate flange and being without use of the spring clip.
Figure 3:
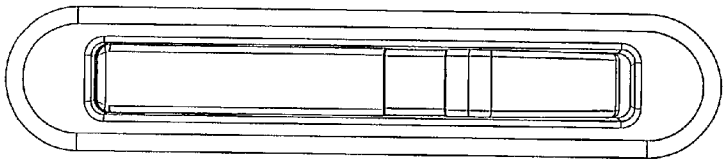
FIG. 3 is a top view of the vent stop of FIG. 1.
Figure 2:
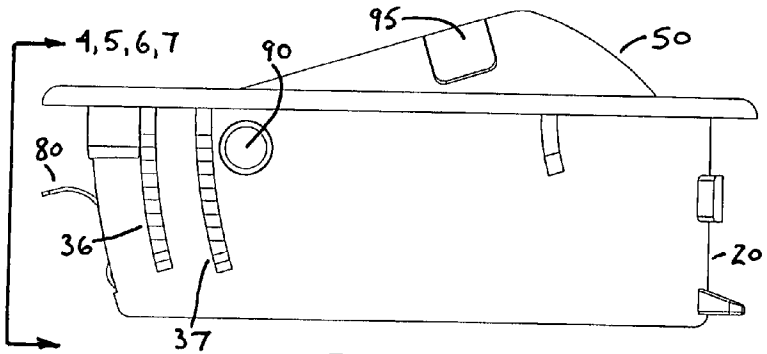
FIG. 2 is a side view of the vent stop of FIG. 1.
Figure 5:
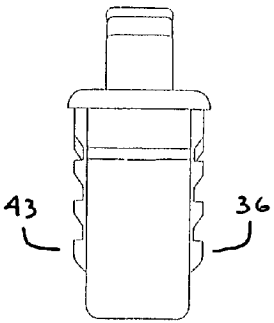
FIG. 5 is an end view of an alternative embodiment of the stop of FIG. 1, being without use of the spring clip.
Figure 9:
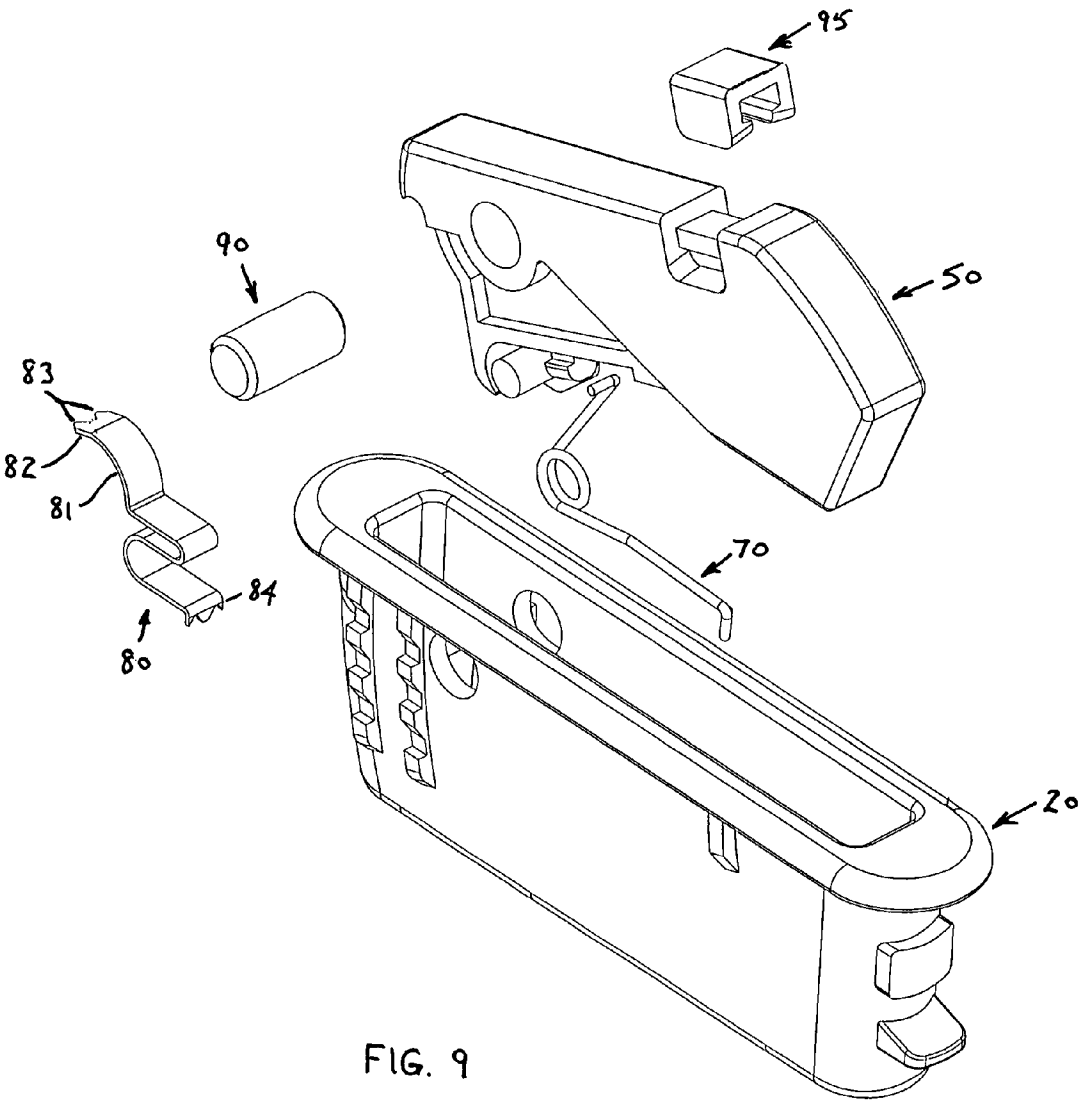
FIG. 9 is an exploded view of the parts of the vent stop of FIG. 1.
Figure 12:
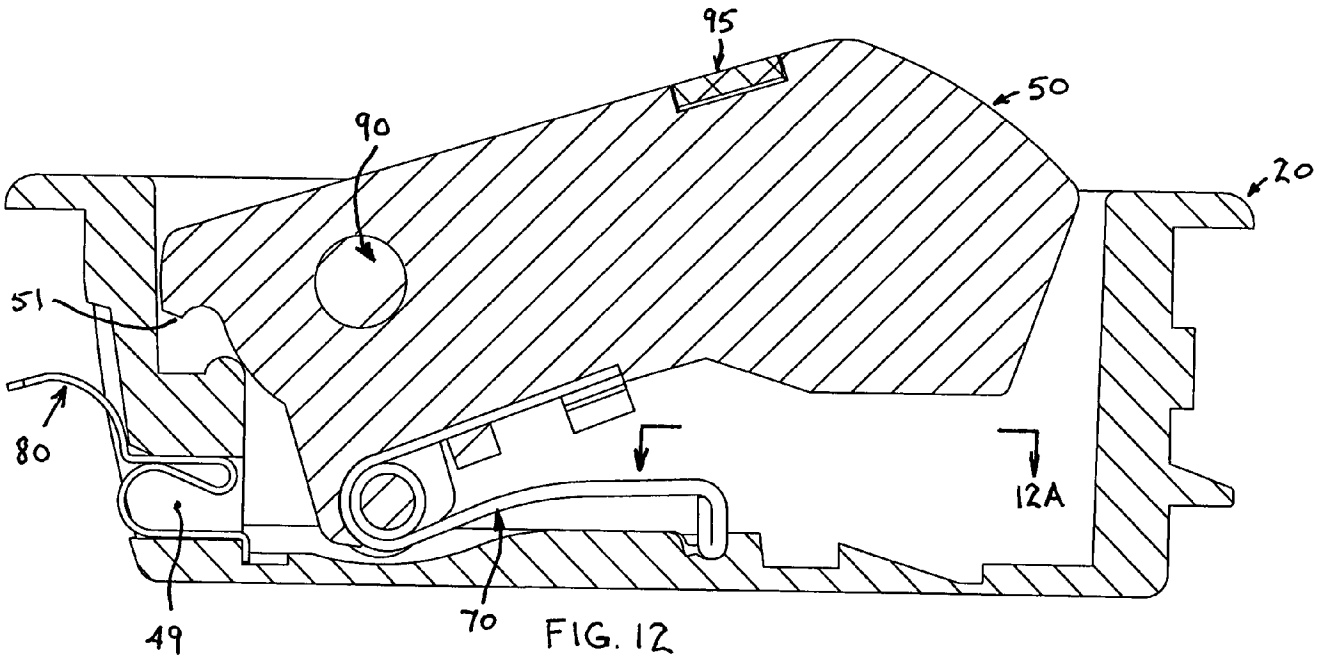
FIGS. 12 and 12*a* are a cross-section of the stop of FIG. 1.
Figure 12A:
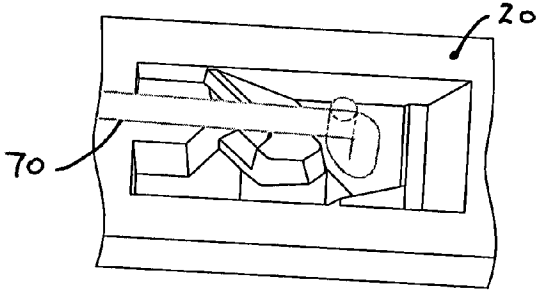

As seen in FIG. 2, and the cross-sectional view in FIG. 12, the housing second end 30 may comprise a protrusion in the form of a spring clip 80. Spring clip 80 may be integrally formed with the housing, or, as seen in FIG. 9, the spring clip 80 may be a separate part and may be comprised of a series of turns to form an S-shape, and may be inserted into opening 49 in the housing, and be retained therein by a flange 84 of the spring clip contacting an interior housing wall. Spring clip 80 may preferably be formed of a suitably flexible material, including, but not limited to, aluminum, chrome vanadium, and stainless steel. The physical proportions of the spring clip 80 may be such that they permit the spring clip to be deformed during its installation, but nonetheless provide sufficient biasing to engage the material of the window once installed into the opening therein.

The portion of spring clip 80 that may protrude from the housing 20 may preferably be curved, and may be so curved so as to take a circular shape 81 (FIG. 9). The circular shape 81 may transition into a straight portion 82. The straight portion 82 may terminate in a protruding end that may comprise one or more teeth 83. The teeth 83 may serve to better enable the spring clip, in conjunction with the biasing produced through its construction, to engage the material of the window to better retain the vent stop within the window opening. The behavior of the spring clip is best discussed in terms of the overall installation of the vent stop 10.

Figure 13:
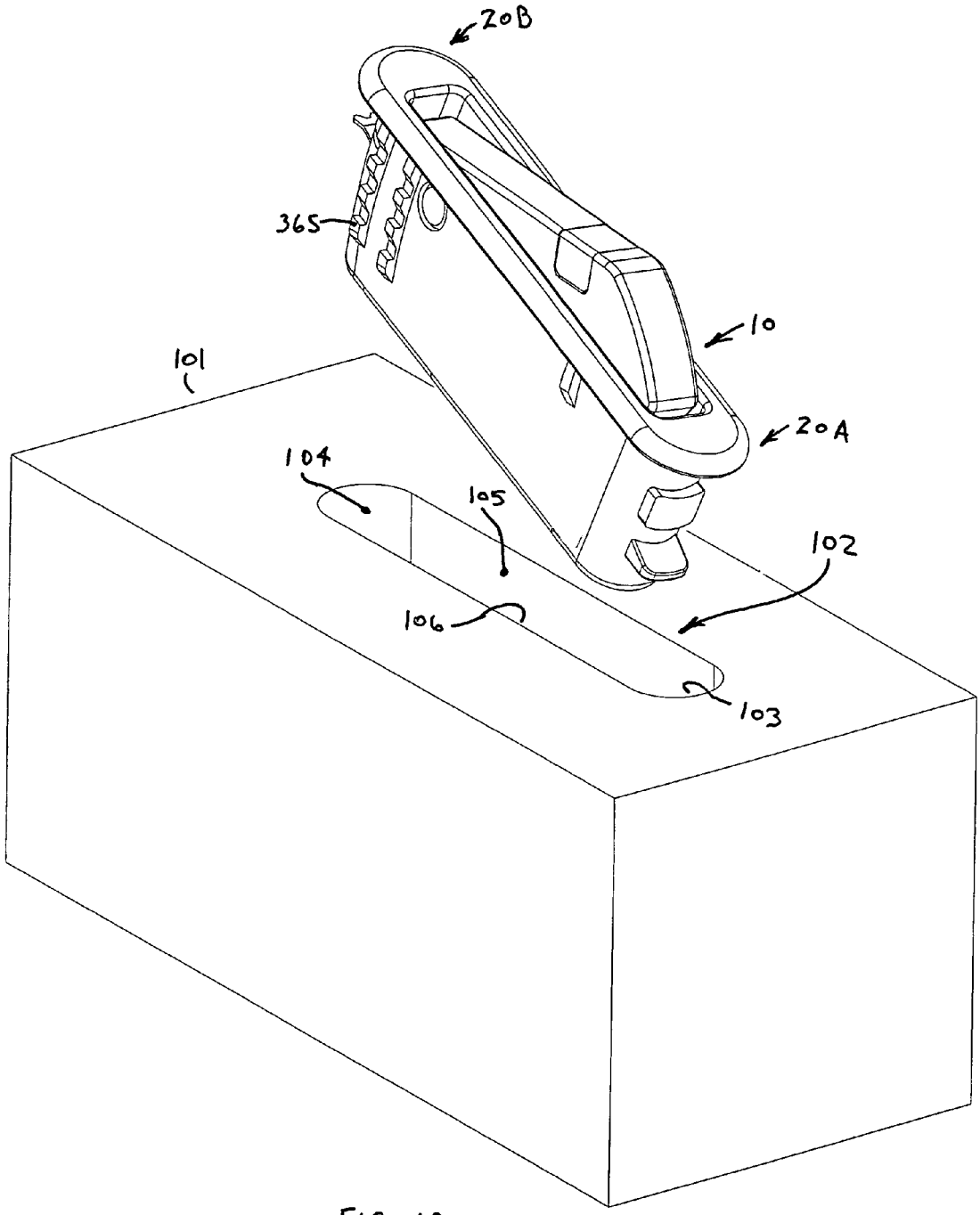
FIG. 13 is a perspective view of the vent stop of FIG. 1 ready to be installed into a slot of a window or door.

As seen in FIG. 13, the vent stop 10 may be installed into an opening 102 in a window 101, where the opening 102 may be on the master window frame, or, in the case of double-hung sash windows, the opening may be in one of the sliding sash members to inhibit travel of the other sash member. The opening 102 may be a race-track shaped opening, or it could simply be a rectangular-shaped opening, but in either case, the cross-section of the opening may preferably match the cross-sectional shape of the features of the housing 20 of vent stop 10. The size of the opening 102 will necessarily be smaller than the periphery 24 of the top plate 21, but must be coordinated with the extent of the retention means of the housing, as discussed in the following paragraphs.

Figure 14:
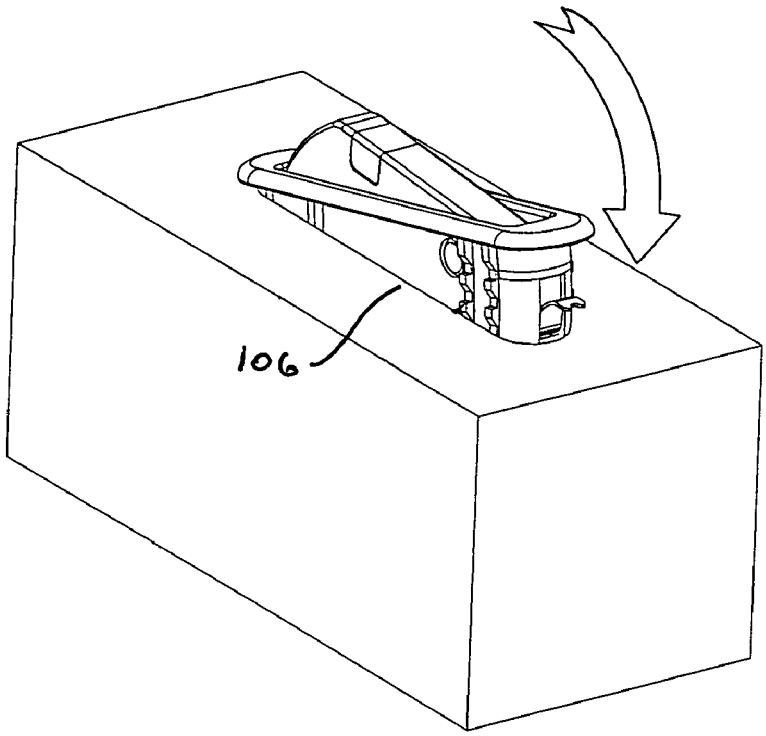
FIG. 14 is the perspective view of FIG. 13, with the stop being rotated into the slot of the window.
Figure 14A:
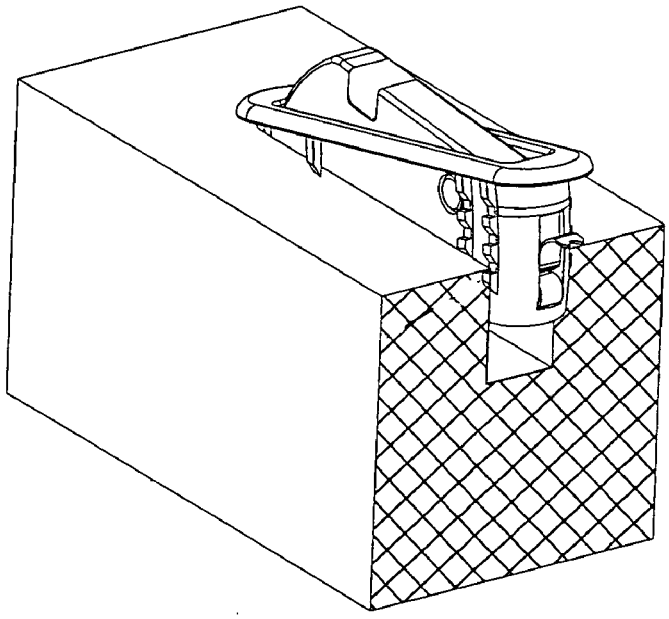
FIG. 14A is the perspective view of FIG. 14 with the window/door being cut away to expose the stop.
Figure 15:
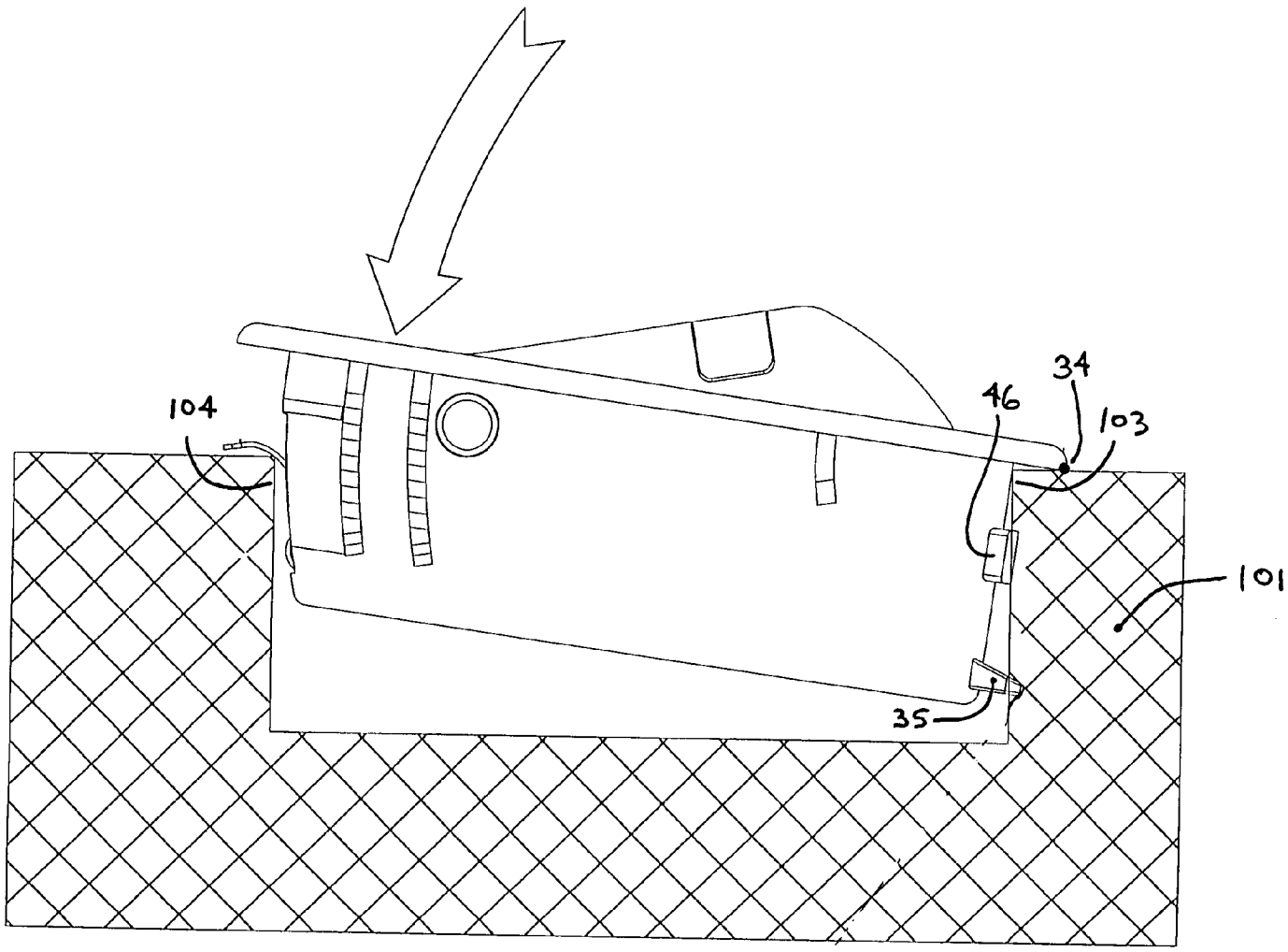
FIG. 15 is a side cross-sectional view of the stop being rotated into the slot of the window, with the spring clip contacting the face of the window, prior to deformation.
Figure 16:
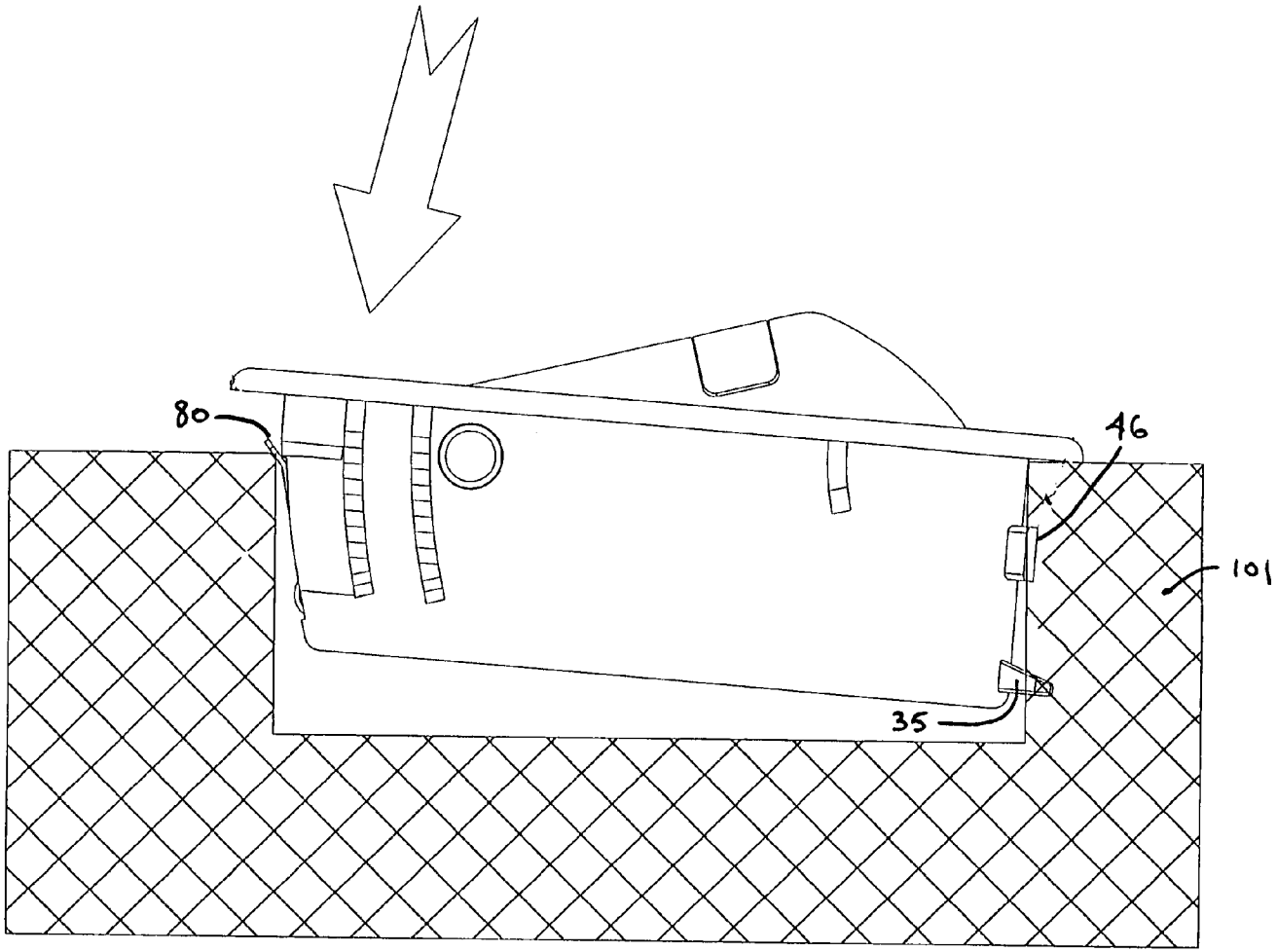
FIG. 16 is the side cross-sectional view of FIG. 15, with the stop being further rotated into the slot of the window, and with the spring clip deforming as it enters the slot of the window.
Figure 19A:
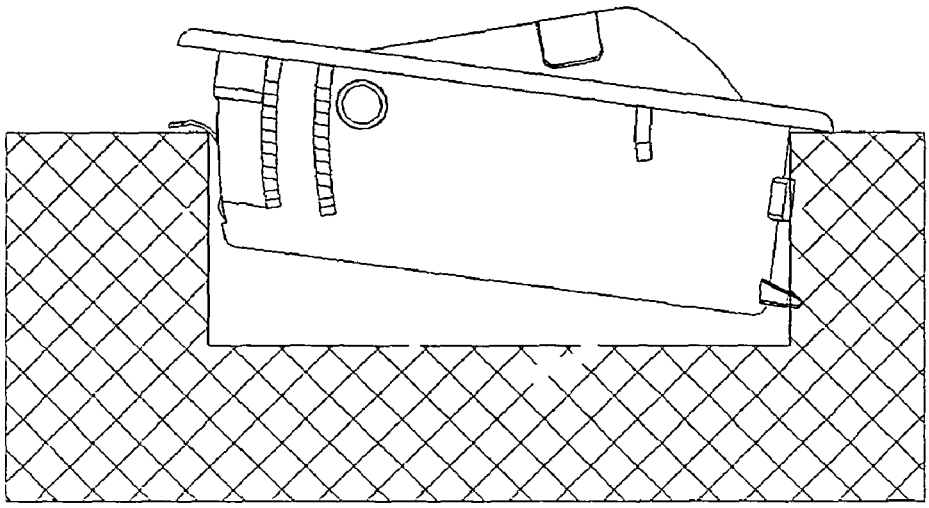
FIGS. 19A-19C comprise the installation steps of FIGS. 15, 16, and 17 shown in sequence on the same drawing sheet.
Figure 20:
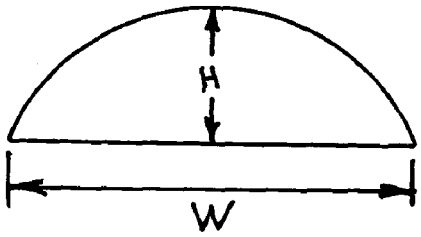
FIG. 20 is a descriptive geometric view usable to relate the height, width, and radius dimension of an arc-segment, with the shown equation.

The vent stop 10 may be inserted into the opening 102 at an angle, with a portion of the housing first end 20A being positioned to first enter the opening 102 proximate to the first end 103 of the opening. The housing first end 20A may be inserted such that point 34 (FIG. 11) on the bottom surface 23 of the top plate 21 contacts the face of the window frame or sash member, as seen in FIGS. 14, 15, and 19A. The vent stop 10 may rotate freely until the protruding end of spring clip 80 approaches the second end 104 of opening 102, or until the teeth of the arcuate flanges 36-38 and 43-45 begin to contact the sides 105 and 106 of the opening 102. Applying a force to the top plate 21 (FIG. 15) at the housing second end 20B may then cause the end surface 35E of the wedge-shape protrusion 35 to engage the material of window 101, and become embedded therein, and may also cause the beginning of the unidirectional engagement of the arcuate flanges 36-38 and 43-45 with the cavity side surfaces 105 and 106 of opening 102. However, if flanges 36-37 and 43-44 comprise an arc segment having a sufficiently large width (Note, radius equation: $R=H/2+W^2/8H$, see FIG. 20), so that they cover most of the walls 27 and 28 to reach most of the way to bottom wall 31, the flanges may engage the opening 102 prior to the wedge-shaped protrusion 35 engaging the material of the window. The width of the arc-segment of flanges 36-37 and 43-44 and the extent of wedge-shaped protrusion 35 protruding from wall 29 may be coordinated in size to simultaneously engage the window, as the vent stop is pivoted during installation.

Figure 19B:
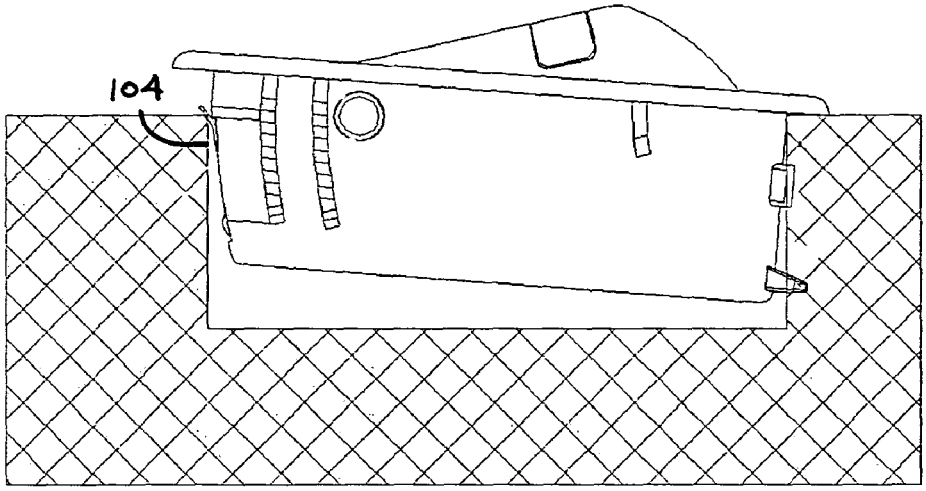

As the spring clip 80 contacts the window 101, continued application of the force to the top plate 21 causes further engagement of the wedge-shaped protrusion 35, as well as deformation of the spring clip 80. The sequence of steps in the installation of the vent stop 10 is viewable in the views comprising FIGS. 19A, 19B, and 19C. Deformation of the spring clip 80 may cause it to appear as it does in FIG. 19B. With continued application of force to the top plate 21 to continue the pivotal installation of vent stop 10, the housing wall 30 may contact the protruding end of spring clip 80 to drive it into the second end 104 of opening 101, so that the teeth 83 of said protruding end of the spring clip 80 engage material of the window. The biasing of the spring clip 80 may be sufficient by itself to engage the material of the window, particularly where the window is made of wood. In an alternative embodiment, the protruding portion of spring clip 80, when deflected upon installation, may fall short of reaching the housing wall 30, so that as the vent stop 10 is pivoted, the angled portion 30A of the housing wall 30 may serve to shoe-horn the stop into the opening 102. In this case, the biasing of the spring clip 80 would independently serve to cause its engagement with the window opening 102.

Figure 19C:
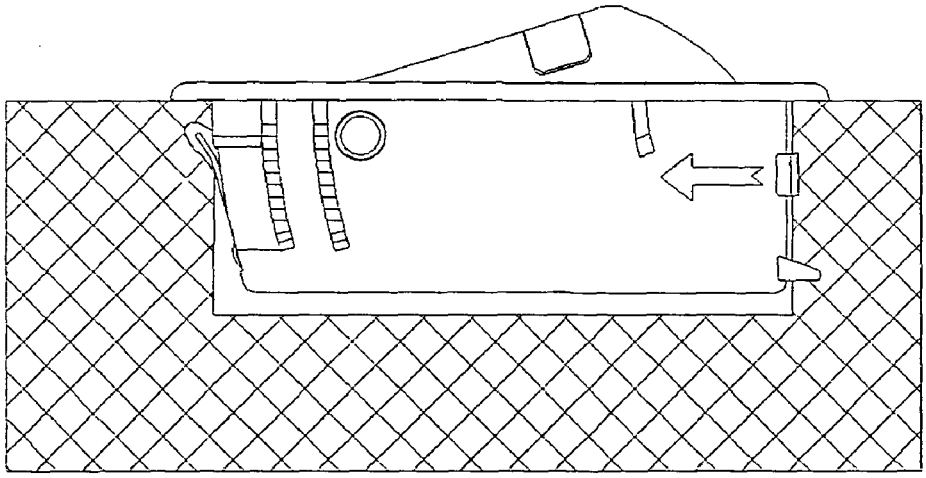

This engagement of the spring clip 80, as positioned in FIG. 19C, may be slightly exaggerated. However, attempts to counter-rotate the vent stop 10, to initiate its removal from the window, would result in driving the teeth 83 of the spring clip 80 further into the window, as seen in the figure, and thus serves to help anchor the vent stop once fully installed in the opening. The vent stop 10 is fully installed in the window opening 102 when the top plate 21 at the housing second end 20B comes in contact with the window (FIG. 19C) face. By the time the top plate 21 at the housing second end 20B makes contact with the window, another protrusion protruding from the housing first end wall 29, which may preferably be block-shaped protrusion 46, may also contact the end surface 103 of the window opening 102. The block-shaped protrusion 46 may preferably be located between the top plate 21 and the wedge-shaped protrusion 35.

It is important to note the coordination between the size of the opening 102 in the window 101, and the extent of the vent stop 10 in both principal directions—side-to-side and end-to-end. The distance between the face of the block-shaped protrusion 46 and the second end wall 30 (denoted by length dimension 47 in FIG. 11) and the distance between cavity end surfaces 103 and 104 of window opening 102 may be set to create a small interference fit, meaning that the distance between end surface 103 and 104 may be slightly smaller than the length dimension 47. As such, the block-shaped protrusion 46 may be driven to engage and form an indentation in the window opening, just like the wedge shape protrusion 35, though to a lesser extent (see FIG. 19C). Similarly, the distance between the generally planar surfaces 36S and 43S of the vent stop 10 (FIG. 11A) and the distance between the cavity side surfaces 105 and 106 of window opening 102 (FIG. 13) may be set to create a small interference fit at installation, meaning that the distance between side surfaces 105 and 106 may be slightly smaller than the distance between the generally planar surfaces 36S and 43S. The small interference fit may serve to aid in the unidirectional engagement of the flanges 36-37 and 43-44 with the window opening. In addition, the window opening 102, particularly in the case where the window is wooden, may be formed using a manufacturing process that creates side surfaces 105 and 106 having a considerable surface roughness, which may aid in the unidirectional engagement of the flanges, since conversely, a relatively smooth surface finish may serve to counter the unidirectional nature of the arcuate flanges.

The tumbler 50 may have a first end and a second end, with the tumbler 50 being pivotally mounted to the housing 20 using pin 90 through in-line orifices 48 in walls 27 and 28 (FIG. 11). Being so mounted, the tumbler 50 may be pivotable between a retracted position (FIG. 17), wherein the tumbler is at least partially disposed within the housing cavity, and an extended position (FIG. 18), wherein at least a portion of the tumbler second end is protruding out the opening 21P of the top plate 21. Outward pivotal travel of the tumbler 50 into the extended position may be limited by a stop feature 51 on the tumbler contacting a complementary housing feature (FIG. 12). The biasing member 70 biases the tumbler to pivot outward from said housing into the extended position. When the tumbler 50 is in said extended position, a portion of the tumbler second end limits movement of a sliding sash of the window, but it permits free sash movement when the tumbler 50 is in the retracted position.

Figure 10:
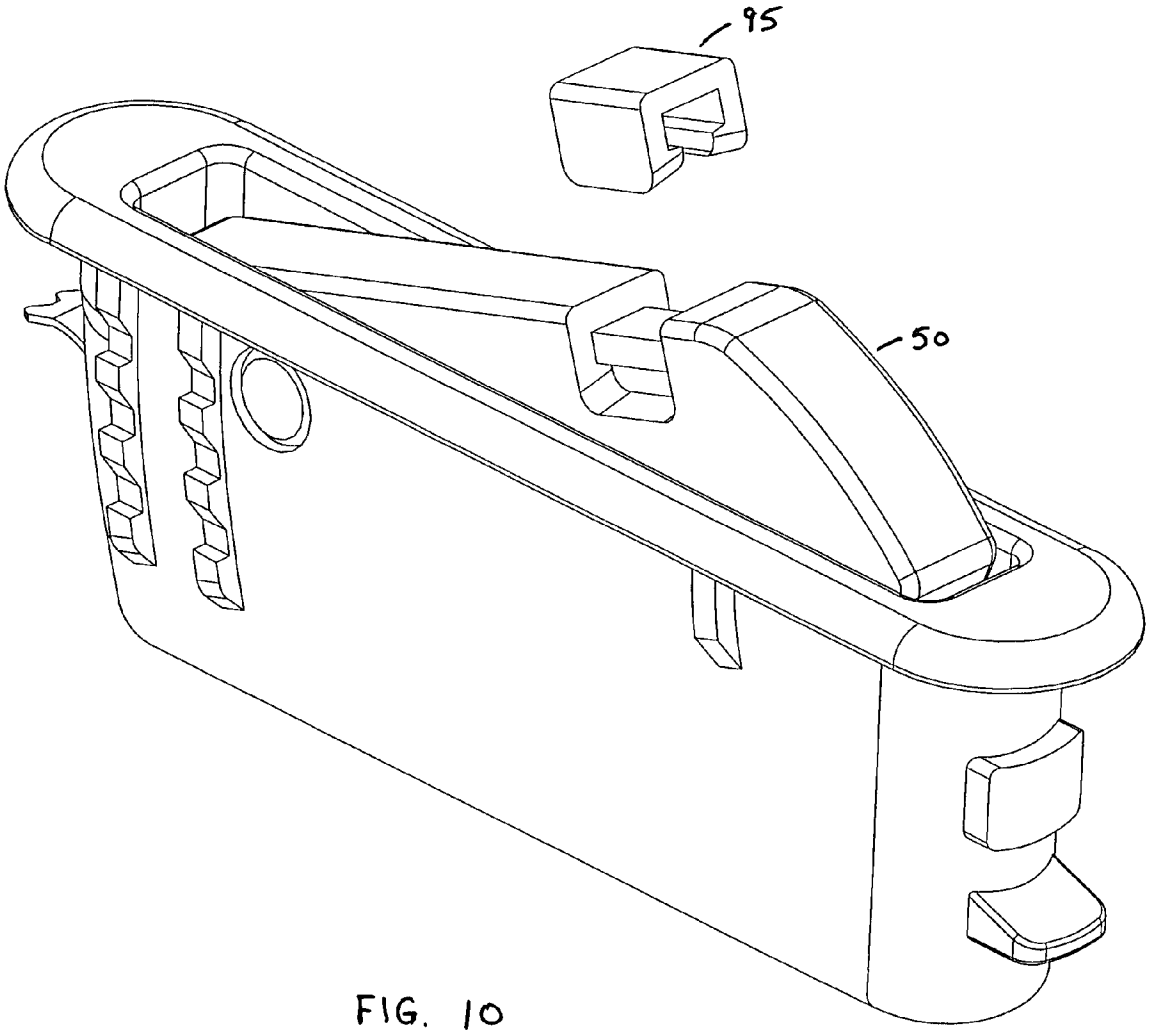
FIG. 10 is a perspective view of the vent stop of FIG. 1, with the indicator shown detached from the tumbler.

The vent stop may further comprise a colored signal 95 (FIGS. 9 and 10) which may be a c-shaped member that may attach on to the tumbler. It may snap-on to the tumbler 50, of be attached using fasteners. The signal 95 may provide indication to a person that the tumbler is in the extended position.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A vent stop comprising:

a housing, said housing having a first end and a second end, said housing comprising:

(a) a top plate, said top plate comprising an opening;

(b) one or more housing walls, said one or more walls extending from said top plate to a distal bottom to form a cavity; said one or more housing walls comprising a first end wall portion and a second end wall portion at said first and second ends of said housing, respectively, and a first elongated side wall portion and a second elongated side wall portion with each extending between said first and second end wall portions; said one or more housing walls extending generally orthogonally from said top plate; a portion of said second end wall portion comprising curvature to form an arc-segment having an origin being proximate to said top plate at said housing first end;

(c) at least one arcuate flange protruding from said first elongated side wall portion of said one or more housing walls, said at least one arcuate flange being oriented to have an edge with at least a portion therein having a radius of curvature with an origin being proximate to said housing first end; said at least one arcuate flange comprising a side surface, said side surface comprising two or more teeth to permit unidirectional motion upon contact with a faying surface;

(d) at least one arcuate flange protruding from said second elongated side wall portion of said one or more housing walls, said at least one arcuate flange of said second side wall portion being oriented to have an edge with at least a portion therein having a radius of curvature with an origin being proximate to said housing first end; said at least one arcuate flange of said second side portion comprising a side surface, said side surface comprising two or more teeth to permit unidirectional motion upon contact with a faying surface;

(e) a wedge-shaped protrusion protruding from said first end wall portion;

(f) a spring clip, said spring clip protruding from said second end wall portion; and (g) a block-shaped protrusion protruding from said first end wall portion between said top plate and said wedge-shaped protrusion;

a tumbler, said tumbler having a first end and a second end, said tumbler being pivotally mounted to said housing to be pivotable between a retracted position, wherein said tumbler is disposed within said housing cavity, and an extended position, wherein at least a portion of said tumbler second end is protruding out said opening of said top plate;

a means for positioning said tumbler to occupy said retracted position or said extended position; and wherein said protrusion and said at least one unidirectional arcuate flange serve to retain said vent stop within an opening in a window when installed therein.

2. The vent stop of claim 1, wherein said first and second side wall portions and said first and second end wall portions of said one or more housing walls are separately formed as a individual wall members that are joined together using a fastening means.

3. The vent stop of claim 1, wherein said first and second side wall portions and said first and second end wall portions of said one or more housing walls are integrally formed as a unitary wall member.

4. The vent stop of claim 3, wherein said wedge-shaped protrusion is located on first end wall portion to be proximate to said distal bottom of said one or more housing walls; and wherein said at least one arcuate flange on said first and second side wall portions is located proximate to said housing second end.

5. The vent stop of claim 4, wherein each of said first and second elongated side wall portions further comprise a generally flat surface with said at least one arcuate flange respectively protruding therefrom.

6. The vent stop of claim 5, wherein said second elongated side wall portion is a mirror-image copy of said first side wall portion, relative to a mid-plane between said generally flat surface of said first elongated side wall portion and said generally flat surface of said second elongated side wall portion.

7. The vent stop of claim 6, wherein a protruding end of said spring clip comprises one or more serrated teeth.

8. The vent stop of claim 7, wherein said first and second end wall portions of said housing each comprise a semicircular outer surface; and wherein said integrally formed unitary wall member of said housing comprises a race-track shaped outer surface.

9. The vent stop of claim 8, wherein said opening in said top plate comprises a rectangular-shaped opening; and wherein said top plate opening is coterminous with said housing cavity, said housing cavity comprising a generally rectangular-shaped opening.

10. The vent stop of claim 9, wherein said top plate overhangs beyond at least a portion of said one or more housing walls to create a lip.

11. A vent stop comprising:

a housing, said housing having a first end and a second end, said housing comprising:

(a) a top plate, said top plate comprising an opening;

(b) one or more housing walls, said one or more walls extending from said top plate to a distal bottom to form a cavity; said one or more housing walls comprising a first end wall portion and a second end wall portion at said first and second ends of said housing, respectively, and a first elongated side wall portion and a second elongated side wall portion with each extending between said first and second end wall portions; said one or more housing walls extending generally orthogonally from said top plate; a portion of said second end wall portion comprising curvature to form an arc-segment having an origin being proximate to said top plate at said housing first end;

(c) at least one arcuate flange protruding from said first elongated side wall portion of said one or more housing walls, said at least one arcuate flange being oriented to have an edge with at least a portion therein having a radius of curvature with an origin being proximate to said housing first end; said at least one arcuate flange comprising a side surface, said side surface comprising two or more teeth being adapted for substantially providing only unidirectional engagement;

(d) at least one arcuate flange protruding from said second elongated side wall portion of said one or more housing walls, said at least one arcuate flange of said second side wall portion being oriented to have an edge with at least a portion therein having a radius of curvature with an origin being proximate to said housing first end; said at least one arcuate flange of said second side wall portion comprising a side surface, said side surface comprising two or more teeth being adapted for substantially providing only unidirectional engagement; and (e) a wedge shaped protrusion protruding from said first end wall portion;

(f) a spring clip, said spring clip protruding from said second end wall portion; and (g) a block-shaped protrusion protruding from said first end wall portion between said top plate and said wedge-shaped protrusion;

and a tumbler, said tumbler having a first end and a second end, said tumbler being pivotally mounted to said housing to be pivotable between a retracted position, wherein said tumbler is disposed within said housing cavity, and an extended position, wherein at least a portion of said tumbler second end is protruding out said opening of said top plate; and a means for positioning said tumbler to occupy said retracted position or said extended position.

12. The vent stop of claim 11 wherein said first and second side wall portions and said first and second end wall portions of said one or more housing walls are integrally formed as a unitary wall member.

13. The vent stop of claim 11, wherein a protruding end of said spring clip comprises one or more serrated teeth.

14. The vent stop of claim 11, wherein said protrusion at said first end of said housing is wedge-shaped.

15. The vent stop of claim 14, wherein said wedge-shaped protrusion is located proximate to said distal bottom of said one or more housing walls.

16. The vent stop of claim 11, wherein said at least one arcuate flange of said first and second housing side wall portions is located proximate to said housing second end.

17. The vent stop of claim 11, wherein each of said first elongated side wall portion and said second elongated side wall portion comprise a generally flat surface with said at least one arcuate flange protruding therefrom.

18. The vent stop of claim 17, wherein said second elongated side wall portion is a mirror-image copy of said first elongated side portion, relative to a mid-plane between said generally flat surface of said first elongated side wall portion and said generally flat surface of said second elongated side wall portion.

19. The vent stop of claim 11, wherein said first and second side wall portions and said first and second end wall portions of said one or more housing walls are separately formed as a individual wall members that are joined together using a fastening means.

20. The vent stop of claim 11, wherein said first and second end wall portions of said housing each comprise a semicircular outer surface, said one or more housing walls comprising a race-track-shaped outer surface.

21. The vent stop of claim 11, wherein said opening in said top plate comprises a rectangular-shaped opening; and wherein said top plate opening is coterminous with said housing cavity, said housing cavity comprising a generally rectangular-shaped opening.

22. The vent stop of claim 11, wherein said top plate overhangs beyond at least a portion of said one or more housing walls to create a lip.

* * * * *